US008063010B2

(12) United States Patent
Ryther

(10) Patent No.: US 8,063,010 B2
(45) Date of Patent: Nov. 22, 2011

(54) SOLID DETERGENT COMPOSITION AND METHODS FOR MANUFACTURING AND USING

(75) Inventor: Robert J. Ryther, St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 438 days.

(21) Appl. No.: 11/183,159

(22) Filed: Jul. 15, 2005

(65) Prior Publication Data

US 2006/0025325 A1 Feb. 2, 2006

Related U.S. Application Data

(60) Provisional application No. 60/598,752, filed on Aug. 2, 2004.

(51) Int. Cl.

| | |
|---|---|
| ***C11D 17/00*** | (2006.01) |
| ***C11D 1/86*** | (2006.01) |
| ***C11D 3/37*** | (2006.01) |
| ***C11D 7/06*** | (2006.01) |

(52) U.S. Cl. ..... 510/445; 510/446; 510/108; 510/180; 510/189; 510/218; 510/224; 510/298; 510/405; 510/476; 510/477; 510/480; 510/495; 510/504

(58) Field of Classification Search ..... 510/445, 510/108, 180, 189, 218, 276, 469, 495, 504, 510/446, 224, 298, 405, 476, 477, 480
See application file for complete search history.

(56) References Cited

U.S. PATENT DOCUMENTS

| | | | | | |
|---|---|---|---|---|---|
| 4,048,121 | A | * | 9/1977 | Chang | 510/245 |
| 4,497,667 | A | * | 2/1985 | Vashi | 148/254 |
| 4,595,520 | A | | 6/1986 | Heile et al. | |
| 4,680,134 | A | * | 7/1987 | Heile et al. | 510/379 |
| 4,681,914 | A | | 7/1987 | Olson et al. | |
| 4,725,376 | A | | 2/1988 | Copeland | |
| RE32,763 | E | | 10/1988 | Fernholtz et al. | |
| RE32,818 | E | | 1/1989 | Fernholz et al. | |
| 4,846,989 | A | | 7/1989 | Killa | |
| 4,846,993 | A | | 7/1989 | Lentsch et al. | |
| 4,999,124 | A | * | 3/1991 | Copeland | 510/514 |
| 5,013,622 | A | | 5/1991 | Simpson et al. | |
| 5,053,159 | A | * | 10/1991 | Joshi | 510/319 |
| 5,080,819 | A | * | 1/1992 | Morganson et al. | 510/225 |
| 5,340,501 | A | | 8/1994 | Steindorf | |
| 5,419,850 | A | * | 5/1995 | Backes et al. | 510/225 |
| 5,478,502 | A | * | 12/1995 | Swift | 510/350 |
| 5,482,646 | A | * | 1/1996 | Mazzola | 510/349 |
| 5,665,694 | A | * | 9/1997 | Backes et al. | 510/480 |
| 5,830,839 | A | * | 11/1998 | Scepanski | 510/305 |
| 6,124,250 | A | * | 9/2000 | Olson et al. | 510/108 |
| 6,150,324 | A | * | 11/2000 | Lentsch et al. | 510/446 |
| 6,258,765 | B1 | * | 7/2001 | Wei et al. | 510/224 |
| 6,395,702 | B2 | * | 5/2002 | Scepanski | 510/445 |
| 6,395,703 | B2 | * | 5/2002 | Scepanski | 510/445 |
| 6,602,350 | B2 | | 8/2003 | Levitt et al. | |
| 6,645,924 | B2 | | 11/2003 | Klos et al. | |
| 6,726,779 | B2 | | 4/2004 | Klos et al. | |

FOREIGN PATENT DOCUMENTS

| | | |
|---|---|---|
| JP | 03173504 | 7/1991 |
| JP | 2002 201500 | 7/2002 |

OTHER PUBLICATIONS

Archiv der Pharmazie 307(5), pp. 336-340, 1974.

* cited by examiner

*Primary Examiner* — Lorna M Douyon
(74) *Attorney, Agent, or Firm* — Merchant & Gould P.C.

(57) ABSTRACT

A solid detergent composition is provided according to the invention. The solid detergent composition is a result of solidifying a detergent composition precursor. The detergent composition precursor includes at least about 20 wt. % hydratable alkaline component, at least about 5 wt. % surfactant component, and water in an amount sufficient to allow the composition to solidify. Methods for manufacturing and using the solid detergent composition are provided.

23 Claims, No Drawings

SOLID DETERGENT COMPOSITION AND METHODS FOR MANUFACTURING AND USING

This application claims priority to U.S. Application Ser. No. 60/598,752 that was filed with the United States Patent and Trademark Office on Aug. 2, 2004. The entire disclosure of U.S. Application Ser. No. 60/598,752 is incorporated herein by reference.

FIELD OF THE INVENTION

The invention relates to a solid detergent composition and to methods for manufacturing and using a solid detergent composition. The solid detergent composition can be provided as a solid (solidified) mass in a desired shape. The solid detergent composition can be characterized as an alkaline hydration solid and can be provided having a relatively high level of active component for providing cleaning. The solid detergent composition can be diluted with water to provide a detergent use composition available for many applications including, for example, washing vehicles in a commercial vehicle washing facility.

BACKGROUND OF THE INVENTION

Solid detergent compositions formed from a hydratable chemical such as sodium hydroxide are described in the prior art. See, for example, U.S. Pat. No. Re 32,763 to Fernholz et al., U.S. Pat. No. Re 32,818 to Fernholz et al., U.S. Pat. No. 4,595,520 to Heile et al., U.S. Pat. No. 4,680,134 to Heile et al., U.S. Pat. No. 4,681,914 to Olson et al., U.S. Pat. No. 4,725,376 to Copeland, U.S. Pat. No. 4,846,989 to Killa, U.S. Pat. No. 5,080,819 to Morganson et al., and U.S. Pat. No. 5,340,501 to Steindorf. These types of solid detergent compositions are often used in warewashing and textile washing applications.

Liquid detergent compositions are available for use in commercial vehicle washing facilities to clean vehicles. See U.S. Pat. No. 6,602,350 to Levitt et al. and U.S. Pat. No. 6,726,779 to Klos et al. Solid detergent compositions are also available for use in commercial vehicle washing facilities to clean vehicles. See U.S. Pat. No. 6,645,924 to Klos et al.

Liquid concentrates, such as water based liquid concentrates, generally have a maximum chemical activity level that cannot be exceeded while maintaining the components in solution. In addition, liquid concentrates often include high levels of hydrotrope chemistries to avoid component separation in highly active compositions. Accordingly, solid detergent compositions can be desirable by providing a higher chemical activity level than liquid concentrates without the risk of component separation.

SUMMARY OF THE INVENTION

A solid detergent composition is provided according to the invention. The solid detergent composition can be provided as a result of solidifying a detergent composition precursor. The detergent composition precursor includes at least about 20 wt. % hydratable alkaline component, at least about 5 wt. % surfactant component, and water in an amount sufficient to allow the composition to solidify. The detergent composition precursor can include at least about 1 wt. % viscosity control component.

A method for manufacturing a solid detergent composition is provided according to the invention. The method includes steps of mixing a composition comprising surfactant component, hydratable alkaline component, viscosity control component, and water, and heating to a temperature of at least about 130° F. to provide a heated mixture, and molding the detergent composition precursor to provide a molded detergent composition. The method can include an additional step of cooling the molded detergent composition to room temperature.

An alternative method for manufacturing a solid detergent composition is provided according to the invention. The alternative method includes steps of mixing a composition comprising at least about 20 wt. % hydratable alkaline component, at least about 5 wt. % surfactant component, and water in an amount sufficient to allow the composition to solidify, providing the composition in a desired shape, and heating the composition to a temperature of at least about 130° F. and allowing the composition to solidify. The shape of the solid detergent composition can be provided as the shape that corresponds to the shape of the container or mold into which the mixture is provided.

A method of generating a liquid detergent composition is provided according to the invention. The method includes a step of directing a water stream against a solid detergent composition to degrade at least a portion of the solid detergent composition and form a liquid detergent composition. The liquid detergent composition can be further diluted to form a use composition. The solid detergent composition comprises a result of solidifying a detergent precursor composition wherein the detergent precursor composition includes at least about 20 wt. % hydratable alkaline component, at least 5 wt. % surfactant component, at least about 1 wt. % viscosity control component, and water in an amount sufficient to allow the composition to solidify.

DETAILED DESCRIPTION OF THE INVENTION

A solid detergent composition is provided that can be used to generate a detergent use composition for cleaning applications. The detergent use composition refers to the composition that contacts a surface or a substrate for cleaning the surface or substrate. The solid detergent composition can be degraded, dissolved, and/or dispersed in water to form a liquid detergent composition. The liquid detergent composition can refer to the detergent use composition or to a concentrate that can be further diluted to provide the detergent use composition. Reference herein to a "detergent composition" refers to the composition whether it is in the form of a solid, a liquid concentrate, or a use composition. In addition, the phrase "detergent composition precursor" refers to a composition that is used to form the solid detergent composition, or to a component of the composition that is used to form the solid detergent composition.

One application of the solid detergent composition is in the commercial vehicle washing industry where the solid detergent composition can be used in commercial vehicle washing facilities to generate a detergent use composition for cleaning vehicles such as cars, trucks, motorcycles, snowmobiles, bicycles, vans, buses, trailers, railway trains, boats or other watercraft, etc. The types of soils that can be removed include those soils normally encountered as a result of travel of a vehicle (e.g., over roadways for road vehicles). Various soils that attach to vehicles vary depending upon the geographic area and the season. For example, on roadways during winter, anti-icing materials (e.g., salt, pumice, organic solvents such as polyethylene glycol from anti-freeze solutions, and sand) are regularly applied to the roadways. The salt used on roadways may often contain mineral oils or vegetable oils as an additive. In addition, roadway contaminants may appear where agricultural materials used on fields in the spring and summer may run onto the roads. Furthermore, incompletely burned hydrocarbons, leaking vehicle fluids, and spills also contribute to the mix of road dirt which can be transferred onto vehicles. In addition, in various geographic regions, the amounts of contaminants and soils such as clay and dust vary. Although the solid detergent composition can be useful for cleaning vehicles, it is expected that the solid detergent composition can be useful for other applications where it is desirable to provide a solid detergent composition that can be degraded with water to generate a detergent use composition for cleaning surfaces, such as, glass, hard surfaces, ware, textiles, etc.

The solid detergent composition can be formed as a result of solidification of a detergent composition precursor. The detergent composition precursor refers to the composition that includes the components of the solid detergent composition but prior to solidification to form a solid mass. The components of the solid detergent composition can be mixed together to form the detergent composition precursor. In one exemplary technique for forming the solid detergent composition, the detergent composition precursor can be heated or provided at an elevated temperature relative to room temperature so that it forms a liquid, forms into a desired shape, and is allowed to solidify by cooling to room temperature. The heating may take place through external heating or internal heating. External heating refers to the application of heat from a source external to the composition by applying energy to the composition. Exemplary sources of external heating include heaters, mixing, and compressing. In addition, heating can take place via internal heating. Internal heating generally refers to heating as a result of the interaction of the components and can be characterized as an exothermic reaction. An exemplary exothermic reaction includes a hydration reaction.

Solidification of the composition can occur in part because of a hydration reaction. The hydration reaction can cause the solidification of the detergent composition precursor to form the solid detergent composition. Because the detergent composition can solidify as a result of a hydration reaction, the resulting solid mass can be referred to as an "alkaline hydration solid."

Prior to solidification, the detergent composition can be characterized as a flowable mixture (e.g., liquid or solid such as powder or aggregate) that can become molded by, for example, casting into a container, extruding through a die, or compressing into a desired shape. Once the composition solidifies, it can be referred to as the solid detergent composition. The solid detergent composition can be characterized as a solid mass and can be provided in the form of blocks, pellets, tablets, etc. The solid detergent composition can be used to form a liquid detergent composition by allowing a stream of water to degrade a surface of the solid detergent composition. An exemplary device that can be used to generate a liquid detergent composition from a solid detergent is disclosed in U.S. Pat. No. 6,645,924 to Klos et al., the entire disclosure of which is incorporated herein by reference. In such a device, a plurality of blocks of solid detergent composition can be stacked in a hopper where a stream of water degrades the bottom surface of the stacked solids. As the solid detergent degrades, the stack decreases in height and, in time, additional blocks can be added on top. The resulting liquid detergent composition can be considered a detergent use composition or can be further diluted with water to form a detergent use composition. The detergent use composition is the composition that is applied to a substrate or surface to provide cleaning.

The solid detergent composition can be provided as a solid having a melting temperature that allows the composition to resist melting during storage in a warehouse. In general, this means that the solid detergent composition can have a melting temperature of greater than about 122° F.

Solid detergent compositions according to the invention include those solid detergents that can be characterized as solid masses that, when contacted with water, degrade to provide an aqueous detergent composition. An advantage to providing the detergent composition in a solid form such as a solid mass is that it is possible to provide a high concentration of cleaning components. Exemplary solid detergent forms include cast solid blocks, extruded solid blocks, pellets, and tablets. An exemplary size of the solid mass when provided as a block can be about 0.5 gallons to about 3 gallons.

The cleaning components of the detergent composition can be referred to as the active ingredient components ("actives" or "active components"). The components of the detergent composition that do not significantly effect cleaning properties can be referred to as non-active components. Exemplary active components include alkaline components such as caustic, chelating agents, surfactants, corrosion inhibitors, anti-redeposition agents, etc. Exemplary non-active components include water, dyes, and certain processing aids.

It is generally desirable for the solid detergent composition to include a high concentration of active components in order to reduce shipping costs. It is expected that it is generally more economical to ship a highly concentrated composition and dilute the highly concentrated composition at the sites of use to provide the use composition, rather than to ship a much more dilute concentrate. In the case of a solid detergent composition for use in the commercial vehicle washing industry, the solid detergent composition can be provided with a level of actives that can be diluted to a detergent use composition that provides the desired level of soil removal for the soils normally encountered on the surfaces of vehicles that are intended to be washed. Because of the existence of certain soils for removal when cleaning vehicles, it may be desirable to certain types of active ingredients in the composition. A level of incompatibility between surfactants and hydratable alkaline materials is generally known. For example, see U.S. Pat. No. 5,340,501 to Steindorf. Because of this incompatibility, it is believed that prior solid detergent compositions that utilize a hydratable alkaline component for solidification were unable to incorporate certain surfactants or other components and/or were unable to incorporate generally higher levels of surfactants or other components. As a result, prior art compositions had a tendency to use alternative hardening agents such as polyethylene glycol. See, for example, U.S. Pat. No. 6,602,350. The applicants discovered a solid detergent composition that can be manufactured utilizing a hydratable alkaline component for solidification while additionally including desired levels and types of surfactants or other components that are generally considered incompatible with the hydratable alkaline component.

The solid detergent composition having a melting temperature of greater than about 122° F. can be prepared with or without a step of melting. For example, the solid detergent composition can be prepared by melting the components to form a liquid melt and then cooling the liquid melt to form a solid. In addition, the solid detergent composition can be formed by mixing solid detergent composition precursors that can be provided as powders or aggregates, to form a mixture and molding the mixture. The molded mixture can be heated externally or internally, and cooled to provide a solid detergent composition having a melting temperature greater than about 122° F. Heating by external or internal heating can cause the composition to melt and cooling can cause the composition to solidify. It is possible that the level of heating may not cause the solid detergent composition precursors to form a melt if, for example, the solid detergent composition precursors solidify to form a solid detergent composition as a result of interaction among the precursors. External heating refers to applying heat from another source. Internal heating refers to chemical heating that occurs as the components interact. For example, internal heating can result from heat of hydration resulting from the interaction of a hydratable component (e.g., a hydratable alkaline component) and water (e.g., free water or water of hydration). Heating of the solid detergent composition precursors to a temperature above at least about 130° F. can result in the melting of the detergent composition precursors thereby permitting solidification to the final solid detergent composition upon cooling. It should be understood that the solidification can be provided as a result of the hydration reaction, the cooling, or both the hydration reaction and the cooling.

For the case of the solid detergent composition precursor being provided in a liquid form prior to casting or extruding, the detergent composition precursor components can include (1) hydratable alkaline component, (2) surfactant component (3) viscosity control component, and (4) water. For the case of the solid detergent composition precursor component being mixed in solid form (e.g., powder or aggregate) and shaped into a desired form prior to heating, the precursor components include (1) hydratable alkaline component, (2) surfactant component, and (3) water. When the solid detergent composition precursor is provided into a desired shape prior to heating, the precursor components need not include a viscosity control component The hydratable alkaline component is believed to cause solidification as a result of hydration in the presence of the water component. The reaction that occurs can be referred to as a hydration reaction. It is expected that the hydration reaction can be accelerated by the application of heat to the detergent composition precursor. The surfactant component provides the use composition having the desired soil removal properties. The viscosity control component is believed to permit a level of compatibility between the hydratable alkaline component and the surfactant component so that the composition remains processable for a length of time sufficient to allow the composition to be formed into a desired shape for solidification. For example, in the absence of the viscosity control component, it is expected that an otherwise identical composition may solidify too quickly or the viscosity of the composition would increase too rapidly and the resulting composition would not be provided in a desired shape as a result of molding. For example, the composition may not have sufficient time to become cast into a container or extruded through a die. When the detergent composition precursors are provided in a desired final form prior to application of heat, the detergent composition precursors need not include the viscosity control component. The viscosity control component can be excluded or limited to an amount less than that used to delay solidification when there is no need to delay solidification. Additional components can be provided as part of the detergent composition including, for example, chelating agents, flocculants, metal protectants, etc.

The hydratable alkaline component allows the detergent composition to solidify as a result of hydration with water present in the detergent composition precursor. Exemplary hydratable alkaline components include alkali metal hydroxides, silicates, phosphates, carbonates, and borates. Exemplary alkali metal hydroxides include sodium hydroxide and potassium hydroxide. The alkali metal hydroxide can be provided as aqueous solutions and/or as anhydrous alkali metal hydroxide. For example, aqueous solutions of alkali metal hydroxide are commercially available at 50 wt. % and 73 wt. % solutions. It should be understood that a 50 wt. % aqueous solution of alkali metal hydroxide means that the solution contains 50 wt. % water and 50 wt. % alkali metal hydroxide. Anhydrous alkali metal hydroxide is commercially available in the form of prilled solids or beads and can have a mix of particle sizes ranging from about 12-100 U.S. mesh. An exemplary silicate includes sodium metasilicate. Exemplary phosphates include phosphates of the formula:

$$M\text{-}(PO_3M)_n\text{-}OM$$

or the corresponding cyclic compounds.

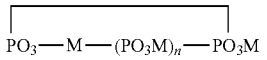

wherein M is an alkali metal and n is a number ranging from 1 to about 60, and is often less than about 10 for cyclic phosphates. Examples of such phosphates include sodium or potassium orthophosphate and alkaline condensed phosphates (e.g. polyphosphates) such as sodium or potassium pyrophosphate, sodium tripolyphosphate, sodium hexametaphosphate, etc. Exemplary carbonates include sodium carbonate and potassium carbonate. An exemplary borate includes sodium borate. Combinations and mixtures of two or more hydratable alkaline materials can be provided such as, for example, sodium hydroxide and sodium tripolyphosphate. Preferred hydratable alkaline components that can be used according to the invention include sodium hydroxide and/or potassium hydroxide. An exemplary form of sodium hydroxide is available under the name Pels Caustic Soda Beads from PPG Corporation.

The hydratable alkaline component can be selected and provided in the detergent composition precursor in an amount sufficient to allow the composition to solidify and exhibit a melting temperature of at least about 122° F. In general, it is expected that storage conditions of the detergent composition in, for example, a warehouse, may achieve a temperature of 122° F. Accordingly, it is desirable for the solid detergent composition to resist softening at temperatures up to about 122° F. It is expected that the melting temperature of the solid detergent composition may be much higher than 122° F. Furthermore, it is expected that the maximum amount of the hydratable alkaline component is selected to allow for the presence of other components in the detergent composition. The amount of the hydratable alkaline component can be at least about 25 wt. %, and can be less than about 80 wt. %. In addition, the amount of hydratable alkaline component can be about 30 wt. % to about 60 wt. %, and can be about 40 wt. % to about 50 wt. %.

Water is available in the detergent composition precursor, prior to solidification, in an amount sufficient to allow the detergent composition precursor to form a solid detergent composition. It is expected that a portion of the water that may be available in the detergent composition precursor as free water becomes water of hydration in the solid detergent composition. It is believed that it is the movement of water from free water to water of hydration that is at least in part responsible for the solidification of the detergent composition. While the water can generally be characterized as free water or water of hydration, it should be understood that the solid detergent composition and the detergent composition precursor may both contain water of hydration and free water, and the characterization that the hydration reaction provides for the movement of free water to water of hydration is not intended to imply that all free water must move to water of hydration.

The water may be provided as softened or deionized water and may be available as a separate ingredient and/or as part of another component. For example, water can be introduced as part of the surfactant component, the hydratable alkaline component, the viscosity control component, etc. For example, a part of the hydratable alkaline component can be an aqueous solution of 50 wt. % sodium hydroxide and 50 wt. % water. The amount of water in the detergent composition precursor, when taking into account the water from various sources, can be an amount sufficient to allow the detergent composition precursor to form the solid detergent composition. It is expected that if there is too little water or too much water, the detergent composition precursor will not form a solid but will, instead, form a paste, a powder, a slurry, etc. In addition, it should be understood that the amount of water may vary as a result of the amount of the hydratable alkaline component. In general, it is expected that the detergent composition precursor will contain at least about 5 wt. % water and will contain less than about 25 wt. % water. In addition, the composition can contain between about 7 wt. % and about 22 wt. % and between about 10 wt. % and about 20 wt. % water, based on the weight of the detergent composition.

The surfactant component can be provided as a surfactant or mixture of surfactants. The amount of the surfactant component and the selection of the surfactant component can be provided to achieve the desired detersive properties in order to provide desired soil removal in the expected environment in which the detergent composition will be used. For example, when the detergent composition is used for cleaning vehicles in a commercial vehicle washing facility, the detergent composition can be designed depending upon the local soils expected at particular locations. Certain locations may experience a heavier level of clay soiling compared with another location. As a result, the surfactant component of the detergent composition can be designed to address the heavier clay soiling at a particular locality. In general, the amount of surfactant component in the detergent composition can be at least about 5 wt.% to provide desired detersive properties. In addition, the amount of surfactant component can be limited in view of the cost or expense of the surfactant component. Accordingly, the amount of surfactant component in the detergent composition can be provided at less than about 30 wt.%. In addition, the amount of surfactant component in the detergent composition can be about 8 wt.% to about 25 wt.%, and can be about 10 wt.% to about 20 wt.% based on the weight of the detergent composition.

Various surfactants that can be used as the surfactant component include nonionic surfactants, anionic surfactants, cationic surfactants, zwitterionic surfactants, amphoteric surfactants, and mixtures thereof.

The surfactant component can include a nonionic surfactant component to provide general soil removal properties. The nonionic surfactant component can be a single type of nonionic surfactant or a mixture of nonionic surfactants. Although the surfactant component can include a nonionic surfactant component, it should be understood that the nonionic surfactant component can be excluded from the detergent composition, if desired.

Nonionic surfactants that can be used in the detergent composition include polyether (also known as polyalkylene oxide, polyoxyalkylene or polyalkylene glycol) surfactants. Exemplary polyether surfactants include polyoxypropylene surfactants and polyoxyethylene glycol surfactants. Typically, the surfactants useful in the context of this invention are synthetic organic polyoxypropylene (PO)-polyoxyethylene (EO) block copolymers. These surfactants comprise a diblock polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. An exemplary average molecular weight range of useful surfactants can be about 1,000 to about 40,000 and the weight percent content of ethylene oxide can be about 10-80% by weight.

Other useful nonionic surfactants include alcohol alkoxylates having EO, PO, and/or butylenes oxide (BO) blocks. Exemplary surfactants are available under the name Plurefac from BASF. Other useful nonionic surfactants include capped aliphatic alcohol alkoxylates. These end caps include but are not limited to methyl, ethyl, propyl, butyl, benzyl and chlorine. Also nonionic surfactants comprising a fatty acid alkoxylate wherein the surfactant comprises a fatty acid moiety with an ester group comprising a block of EO, a block of PO or a mixed block or heteric group. The molecular weights of such surfactants can be about 400 to about 10,000. An exemplary surfactant can have an EO content of about 30-50 wt. % and wherein the fatty acid moiety contains from about 8 to about 18 carbon atoms.

Other useful nonionic surfactants include alkyl phenol alkoxylates. Such surfactants can be made from an alkyl phenol moiety having an alkyl group with about 4 to about 18 carbon atoms, can contain an ethylene oxide block, a propylene oxide block, or a mixed ethylene oxide, propylene oxide block or heteric polymer moiety. Such surfactants can have a molecular weight of about 400 to about 10,000 and can have from about 5 to about 20 units of ethylene oxide, propylene oxide or mixtures thereof.

Exemplary nonionic surfactants that can be used include fatty alcohol $C_{12}$-$C_{14}$ with about 5 moles ethylene oxide and 4 moles propylene oxide available under the name Dehypon LS-54 from Henkel Corporation, and $C_{12}$-$C_{16}$ oleochemical polyglycol ether available under the name Surfonic L 24-7 from Huntsman.

The detergent composition can exclude the nonionic surfactant component. When the detergent composition includes the nonionic surfactant component, the nonionic surfactant component can be provided in an amount of about 1 wt. % to about 30 wt. %, about 2 wt. % to about 20 wt. %, and about 5 wt. % to about 15 wt. % based on the weight of the detergent composition.

The detergent composition can include an anionic surfactant component to provide desired detersive properties. Anionic surfactants are generally useful for removal of oil and clay soils. The anionic surfactant component can be provided as a single anionic surfactant or as a mixture of anionic surfactants.

Anionic surfactants are generally characterized by the presence of an anionic segment in the surface active segment of the molecule. The anionic surfactant is usually in the form of a salt, but may also be Zwitterionic or an internal salt. Exemplary anionic surfactants that can be used according to the invention include sulfonates such as linear alkyl benzene sulfonate and alpha olefin sulfonate, sulfates such as lauryl sulfate and lauryl ether sulfate, natural soaps and phosphate esters. Further examples include dimers, trimers, oligomers, polymers (copolymers, graft polymers, block polymers, etc.) having anionic surfactant groups thereon, such as amine groups, phosphate groups or other polar charge centers with hydrophilic and/or hydrophobic contribution segments. The surfactant normally contains both a hydrophilic and a hydrophobic center or segment in the molecule to be able to be soluble or dispersible in water, yet display oleophilicity (e.g. dispersing and/or dissolving or attracting power) toward oils, grease and other non-aqueous, oleophilic materials.

An anionic surfactant that can be used includes sodium dodecylbenzene sulfonate available under the name Witcolat 90 flake from Witco Corporation.

The detergent composition can exclude the anionic surfactant component. When the detergent composition includes the anionic surfactant component, it can be included in an amount of about 1 wt. % to about 30 wt. %, about 2 wt. % to about 20 wt. %, and about 5 wt. % to about 15 wt. % based on the weight of the detergent composition.

The detergent component can include a cationic surfactant to provide desired detersive properties. In general, cationic surfactants are generally useful for imparting a shine to a vehicle surface. For example, when the detergent composition includes no cationic surfactant, it is expected that the surface of the vehicle will be duller than the surface of a vehicle after treatment with an otherwise identical detergent composition except containing a cationic surfactant.

Cationic surfactants that can be used include polyoxyethylene tertiary alkyl amines, alkenyl amines, ethoxylated fatty amines, quaternary ammonium surfactants, and polyoxyethylene alkyl etheramines. Examples of cationic surfactants include polyoxyethylene (5) cocoamine, polyoxyethylene (15) tallowamine, distearyldimethylammonium chloride, N-dodecylpyridine chloride, and polyoxypropylene (8) ethoxytrimethylammonium chloride.

Additional cationic surfactants include those disclosed by U.S. Patent No. 6,602,350, such as, alkoxylated cationic ammonium surfactant. These cationic surfactants are commercially available, for example, as Witco Chemicals Cationic quaternary ammonium compounds Emcol CC-9, Emcol CC-36, and Emcol CC-42. A preferred compound is commercially provided as GLENSURFTM™ 42, which is inaccurately described as "Diethylammonium Chloride" in a PRODUCT DATA SHEET provided by Glenn Corporation, which sells the product. The CAS Number for the actual compound is 68132-96-7, its Chemical Abstract name is Poly [oxy(methyl-1,2-ethanediyl)], alpha-[2-diethylmethylammonio)ethyl]-omega-hydroxy chloride. The alkoxylated ammonium cationic surfactants used in the present invention may be generally defined according to the formula:

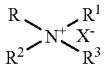

wherein R, R1 and R2 are independently selected from lower alkyl groups (C1-C4 alkyl groups), R3 comprises a polyoxyalkylene chain, and X comprises an anion (any anion is useful, acid anions preferred, such as chloride, iodide, bromide, fluoride, acetate, phosphate, sulfate, etc.). An exemplary type of polyoxyalkylene chain (also referred to as a poly[oxyalkylene] chain) would have the general formula:

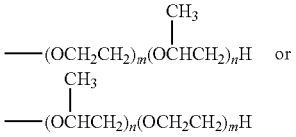

wherein m is from 0 to 30, n is from 1 to 60, and m plus n is from 1 to 60, and n>m. It is preferred that the ratio of n/m is at least 2, more preferred that n/m is at least 4, and still more preferred that n/m is greater than 5 or even the m=0. It is also preferred that m+n is within the range of 5 to 60, still more preferred that m+n is within the range of 8 to 50, and the most preferred being where m=0 and n=35-45 (e.g., 42). The anion is fairly inert in the system except for its solubility characteristics, which are well understood in the art. Simple anions, especially simple or lower molecular weight acid anions such as chloride, bromide, iodide, sulfate, paratoluene sulfonate, acetate, nitrate, nitrite, phosphate, and the like are conveniently selected as the counterion in the cationic surfactant. It is an option that the total number of carbon atoms among R, R1, and R2 have a combined number of fewer than 12 carbon atoms (with the possible maximum being 12 carbon atoms). It is an additional option that the total number of carbon atoms in the R, R1, and R2 groups are between 3 and 12 carbon atoms or between 4 and 8 carbon atoms. The most common form of this class of surfactants has R, R1, and R2 as one methyl radical and two ethyl radicals. In describing compounds by structure and formula in the practice of the present invention, it is well understood that substitution of the compounds would be practiced within the background skill of one ordinarily skilled in the art.

The detergent composition can exclude the cationic surfactant component. When the detergent composition includes the cationic surfactant component, the cationic surfactant can be present in an amount of about 0.01 wt. % to about 15 wt. %, about 0.1 wt. % to about 10 wt. %, and about 0.5 wt. % to about 2 wt % based on the weight of the detergent composition.

The detergent composition can include zwitterionic or amphoteric surfactants such as beta-N-alkylaminopropionic acids, n-alkyl-beta-iminodipropionic acids, imidazoline carboxylates, n-alkyl-betaines, amine oxides, sulfobetaines and sultaines.

The viscosity control component can be provided for maintaining the viscosity of the detergent composition prior to solidification. In the case where the detergent composition is provided as a melt for molding into a desired shape, the viscosity control component allows the detergent composition to exhibit a desired viscosity for a desired length of time. In general, the viscosity and the length of time is sufficient for allowing the composition to be molded into a desired shape by, for example, casting into a container or extruding through a die. An exemplary viscosity control component can be characterized as a phosphonate and can be particularly identified as aminotris(methylene phosphonic acid) salt (ATMP) and is available under the name Dequest 2000 from Dow Corporation. The Applicants observed that ATMP is an effective cleaning component for vehicle surfaces due to its metal chelating ability. It has been found that several phosphonates do not adequately function as viscosity control components although it is expected that additional phosphonates may, in fact, function as viscosity control components. In addition, other components that may not be considered phosphonates may function as viscosity control components. For example, ethylene-diaminetetraacetic acid (EDTA), available under the name Versene from Dow Corporation can function as a viscosity control component. EDTA can also function as an effective cleaning component for vehicle services due to its metal chelating ability. In addition, it is believed that other components that may not be considered phosphonates may function as viscosity control components. It is unclear why the viscosity control component allows the composition to maintain its viscosity prior to solidification when, in the absence of the viscosity control component, the composition would otherwise become too thick to conveniently process. One theory is that the viscosity control component somehow reduces interaction between surfactant components (e.g. the anionic surfactant component and the cationic surfactant component) and/or between the surfactant component and the hydratable alkaline component.

The amount of the viscosity control component in the detergent composition should be sufficient to provide the composition with the desired viscosity for the desired length of time in order to allow formation of the solid detergent composition in a desired shape. It is believed that the upper limit of the amount of the viscosity control component is determined by the desire to provide room in the detergent composition for other components. The viscosity control component can be included in the detergent composition in an amount of at least about 1 wt. % and can be provided in an amount of less than about 40 wt. %. In addition, the detergent composition can include about 2 wt. % to about 30 wt. %, about 3 wt. % to about 15 wt. %, and about 5 wt. % to about 10 wt. % of the viscosity control component.

Chelating agents can be incorporated into the solid detergent composition to enhance cleaning properties. In the case of a solid detergent composition useful for cleaning vehicles, the presence of a chelating agent is advantageous because many of the soils sought to be removed from a vehicle surface are soils that can be removed as a result of application of a chelating agents. Exemplary chelating agents for metal ions include polycarboxylic acid chelating agents include such natural occurring materials as citric acid and malic acid (and their equivalents) and such conventional synthetic materials such as the aminocarboxylic acid or amine-type carboxylic acid or amine-type acetic acid chelating agents such as ethylene-diaminetetraacetic acid (EDTA), diethylenetriamine-pentaacetic acid (DTPA), hydroxyethylenediaminetriacetic acid (HEDTA), and the many other chelating carboxylic acids known in the art. A good background on the structure and types of the chelating amine-type carboxylic acids is provided in U.S. Pat. No. 5,013,622 and *Archiv der Pharmazie* 307(5), pp. 336-340, 1974. The chelating carboxylic acid is generally used in an amount of from about $1\times10^{-3}$ to 2% by weight of the applied solution (the diluted solution or ready-to-use solution). Where the concentrate may be diluted from 1 to twenty more times, the concentration of the chelating acid in the concentrate may be, for example, about $2\times10^{-3}$ to 50% by weight of the concentrate solution. The chelating acids are often provided as metal salts, especially sodium or potassium salts of the acids, such as trisodium hydroxyethylenediaminetriacetate. Amino phosphates are also suitable for use as chelating agents in the composition of the invention, and include ethylenediaminetetra (methylenephosphonates) (EDTMPA), diethylenetriamine-N,N,N',N",N"-penta(methylene phosphonate) (DETPMP) and 1-hydroxyethane-1,1-diphosphonate (HEDP). Preferably, these amino phosphonates do not contain alkyl or alkenyl groups with more than about 6 carbon atoms.

Exemplary chelating agents include aminocarboxylic acid chelating agents such as N-hydroxyethyliminodiacetic acid, nitrilotriacetic acid (NTA), ethylenediaminetetraacetic acid (EDTA), N-hydroxyethylethylenediaminetriacetic acid (HEDTA), and diethylenetriaminepentaacetic acid (DTPA).

It is pointed out that the phosphonate utilized as the viscosity control component, aminotris(methylene phosphonic acid) salt (ATMP), can be characterized as a chelating agent. As a result, the viscosity control component can provide both viscosity control properties that allow for the formation of the solid detergent composition and chelating properties that are desired when cleaning. Accordingly, when the viscosity control component is ATMP, for example, it is not necessary to include additional chelating agents, although additional chelating agents can certainly be incorporated into the composition. In the event the viscosity control component is not a chelating agent, it may be desirable to include at least about 5 wt.% chelating agent and less than about 80 wt.% chelating agent. In addition, it may be desirable to include about 7 wt.% to about 50 wt.%, and about 10 wt.% to about 30 wt% chelating agent, based on the weight of the composition.

It should be understood that the term chelating agent is often used interchangeably with the term builder. Exemplary components that are often referred to as builders include those components that allow dilution with 20 grain water hardness to use concentration without the formation of an undesirable precipitate. Exemplary builders include aminocarboxylates and their derivatives, phosphonates, phosphates, pyrrophosphates, polyphosphates, ethylenediamine and ethylenetriamine derivatives, hydroxyacids, and mono-, di-, and tricarboxylates (or their corresponding acids), aluminosilicates, nitriloacetates and their derivatives, or mixtures thereof. An exemplary chelant or builder that can be used includes sodium tripolyphosphate that is available from Albright & Wilson.

When incorporating a chelating agent or a mixture of chelating agent into the composition, it should be understood that certain chelating agents may detract or have an adverse effect on viscosity and other chelating agents may be neutral to viscosity. That is, it has been found that certain chelating agents have a tendency to cause the detergent composition precursor to thicken. It is suspected that this thickening may be a result of some type of competition with the viscosity control component. When the chelating agent selected for incorporation into the detergent composition is an adversely effecting chelating agent, it can be added in an amount of about 0.1 wt.% to about 5 wt.% in order to minimize its effect on viscosity. When the chelating agent is considered a neutral chelating agent and does not adversely effect the viscosity of the detergent composition precursor, it can be provided in an amount of about 0.1 wt.% to about 30 wt.%. It should be understood that these ranges of chelating agent are exemplary and that, if possible, it may be desirable to incorporate as much chelating agent as possible into the solid detergent composition to provide desired soil removal properties. Accordingly, if a selected chelating agent is particularly effective for cleaning and it is characterized as an adversely effecting chelating agent but the adverse effect is not that great and allows one to process the detergent composition into a desired shape prior to solidification, then greater amounts of the chelating agent may be incorporated into the composition.

Reducing the occurrence of redeposition of vehicle soils can be assisted by using polymers typically used for flocculating particulates in water treatment formulations. Such components can be referred to as flocculents and are often characterized as high molecular weight polymers. An exemplary flocculent that can be used includes high molecular weight non-ionic polyacrylamide flocculent and is available under the name Hyperfloc NE-823 from Hychem Inc. The flocculent component is not a required component and can be omitted from the composition. When a flocculent is provided, it can be provided in an amount of 0.0001 wt. % to about 20 wt. %, about 0.01 wt. % to about 10 wt. %, and about 0.1 wt. % to about 5 wt. %, based on the weight of the detergent composition.

The solid detergent composition may also include corrosion inhibitors to provide corrosion resistance. Exemplary corrosion inhibitors include silicates, phosphate, magnesium and/or zinc ions. Preferably, the metal ions are provided in a water soluble form. Examples of useful water soluble forms of magnesium and zinc ions are the water soluble salts thereof including the chlorides, nitrates and sulfates of the respective metals.

Additional corrosion inhibitors that may be optionally added to the aqueous cleaning compositions of this invention include magnesium and/or zinc ions. Preferably, the metal ions are provided in water soluble form. Examples of useful water soluble forms of magnesium and zinc ions are the water soluble salts thereof including the chlorides, nitrates and sulfates of the respective metals. An exemplary corrosion inhibitor includes sodium metasilicate and is available under the name Drymet 59 from Incos Corporation.

Corrosion inhibitors are not required and can be omitted from the detergent composition. When the detergent composition includes corrosion inhibitors or metal protectants, they can be included in an amount of about 0.01 wt. % to about 40 wt. %, about 1 wt. % to about 30 wt. %, and about 10 wt. % to about 20 wt. %.

The solid detergent composition may additionally include anti-redeposition agents and sequestrants. Generally, anti-redeposition agents and sequestrants are those molecules capable of complexing or coordinating the metal ions commonly found in service water than thereby preventing the metal ions from interfering with the functioning of detersive components with the composition. In addition, the anti-redeposition agents may also coat particulate matter in a cleaning system increasing the affinity of the particulate for the solution and decreasing the affinity (either adhesive or charge affinity) for the hard surface to be cleaned. Representative anti-redeposition agents and sequestrants include salts of amino carboxylic acids, phosphate salts such as tripolyphosphate salts and pyrophosphate salts, phosphonic acids and their salts, and water soluble acrylic acid polymers and their salts and water suspensions of cationic, nonionic, or anionic acryl amide polymers of various molecular weights among others.

The solid detergent composition can be prepared utilizing a processing aid. In general, a processing aid refers to a component that assists in the formation of the solid detergent. An exemplary processing aid that helps in the formation of a solid detergent includes propylene glycol and hexylene glycol.

The solid detergent composition can include hydrotropes. In general, hydrotropes are useful to maintain the organic materials including the surfactant, readily dispersed in an aqueous cleaning solution and allow the user of the compositions to accurately provide the desired amount of the liquid detergent concentrate into the use solution. Examples of hydrotropes include the sodium, potassium ammonium and alkanol ammonium salts of xylene, toluene, ethylbenzoate, isopropylbenzene, naphthalene, alkyl diphenyloxide disulfonates, alkyl naphthalene sulfonates, phosphate esters of alkoxylated alkyl phenols, phosphate esters of alkoxylated alcohols and sodium, potassium ammonium salts of the alkyl sarcosinates.

Other additives include, but are not limited to, additional surfactants, hydrotropes, additional corrosion inhibitors, antimicrobials, enzymes, soil releases, fungicides, fragrances, dyes, antistatic agents, UV absorbers, reducing agents, buffering compounds, viscosity modifying (thickening or thinning) agents, and the like may be added either into the solid or mixed into the use solution prior to vehicle washing without departing from the concept of the invention.

Exemplary amounts of various components of the solid detergent composition are reported in Table 1 for the situation where the detergent composition precursor includes the viscosity control component. It should be understood that the same ranges of components can be provided without the viscosity control component when the solid detergent composition can be provided having a desired shape without the use of the viscosity control component. In addition, if the composition does not require the presence of a viscosity control component in order to provide the composition in a desired shape prior to solidification, the composition may or may not include the viscosity control component. For example, the viscosity control component can be included in the composition even if the composition is provided in a desired shape and then allowed to solidify. It if is desired to characterize the absence of the viscosity control component, the composition can be characterized as having less than 1 wt. % viscosity control component, and the composition can be characterized as having 0 wt. % viscosity control component.

TABLE 1

| Component | First Range (wt. %) | Second Range (wt. %) | Third Range (wt. %) |
|---|---|---|---|
| hydratable alkaline | 25–80 | 30–60 | 40–50 |
| water | 5–25 | 7–22 | 10–20 |
| Total surfactant | 5–30 | 8–25 | 10–20 |
| nonionic surfactant | 1–30 | 2–20 | 5–15 |
| anionic surfactant | 1–30 | 2–20 | 5–15 |
| cationic surfactant | 0.01–15 | 0.1–10 | 0.5–2 |
| viscosity control component | 1–40 | 2–30 | 3–15 |
| chelating agent | 5–80 | 7–50 | 10–30 |
| flocculent | 0.001–20 | 0.01–10 | 0.1–5 |
| corrosion inhibitor | 0.01–40 | 1–30 | 10–20 |

Method of Forming Solid Detergent Composition

The detergent composition precursor can be provided as a melt that is allowed to cool to room temperature and solidify as a result of cooling. The melted detergent composition precursor can be provided as a result of heating the detergent composition precursor, and then casting or extruding the melted detergent composition precursor to form a composition having a desired shape, and then allowing the composition to cool to form a solid detergent composition. Alternatively, the detergent composition precursor components can be mixed together (e.g., in a powdered or aggregate form) and formed into a desired final shape prior to heating. The composition can then be heated and allowed to cool to room temperature to solidify as a result of cooling.

The heating can occur with external heating, internal heating, or a mixture of external heating and internal heating. External heating refers to the application of heat to the composition from a source outside of the composition. External heating can take the form of application of heat or the generation of heat as a result of mechanical operations such as mixing or compressing. Internal heating refers to heating as a result of chemical interaction (e.g., heat of hydration). When forming a melt prior to casting or extruding the detergent composition, the Applicants observed that combining high caustic levels in a melt with high levels of surfactant, especially anionic surfactant, resulted in melts having an unacceptably high viscosity. In order to avoid this high viscosity, the viscosity control component can be used. For example, in the case of the viscosity control component being aminotris (methylenephosphonic acid) ATMP, 50% NaOH, the viscosity control component can be mixed with other detergent composition precursor components and heated to form the melt that can be cast into a container or extruded into a desired form and allowed to solidify.

It is expected that casting will be a particularly convenient way to allow the detergent composition to solidify. When cast into a container, the container can be provided having a size of between about 0.5 gallon and about 3 gallons. The container can be referred to as a bucket and can include a cap to reduce contact with the composition. The solidification can occur as a result of allowing the composition to cool to room temperature. In addition, in order to enhance the removal of the solid detergent composition from the container, the composition can be cast into a container having a liner. The liner can be provided so that it is attached to the container near or at the opening of the container, and allow the solid detergent composition to slide out of the container. Exemplary designs for such an arrangement are disclosed in U.S. application Ser. No. 10/909,470 entitled "Packaging for Solid Product Release" that was filed with the United States Patent and Trademark Office on Aug. 2, 2004, now published as U.S. Ser. No. 2006/0024492, the entire disclosure of which is incorporated herein by reference.

Various observations were made about the detergent composition as a result of altering certain components. For example, when hydroxyethylene diphosphonic acid tetrasodium salt; ethylene diamine tetraacetic acid; and 1-hydroxy ethylidene-1,1-diphosphonic acid were selected as viscosity control components (replacing ATMP), the resulting caustic melt exhibited a viscosity level that made it impractical to pour hot melted product into molds. The components were evaluated at ranges of approximately 1 wt. % to about 15 wt. %.

The applicants were unable to achieve sufficient hardening of a caustic melt when the amount of water (either added directly or as part of another component) exceeded 50% of the active caustic level. Accordingly, the amount of water in the detergent composition precursor can be selected as less than 50% of the hydratable alkaline component by weight.

Surfactants that are known to have general hydrotropic effects in water based cleaning formulations, materials such as the alkyl diphenyl ether disulfonates and the alkyl naphthalene sulfonates, can be included for lowering the viscosity of surfactant/hydratable alkaline melt formulations. Alkyl naphthalene sulfonate surfactants can increase the melt hardening rate once the melt is cooled below its melting point.

The melt has been observed to be sensitive to the level of silicate based chemistries. Low levels of anhydrous silicate in the melt solution have increased the melt viscosity as it hydrates. If the anhydrous silicate is added after any water in the formulations is tied up by caustic or other components (such as tripolyphosphate), no significant viscosity effects are observed in the melt. This effect has been used to control the final viscosity of the melt by adding a small amount of anhydrous silicate early in the batch make process such that it becomes fully hydrated in the caustic melt solution. If a higher amount of the anhydrous silicate is desired for the formulations, that additional portion can be added at the end of the batch make process such that it does not become hydrated and does not change the melt viscosity.

The final viscosity of the melts can be dependent on the temperature at which caustic bead is added in the formulations. Adding the caustic bead below the caustic bead melt temperature results in a significantly higher final viscosity of the melt solution compared to a melt solution with the identical final solution temperature but where the caustic bead was added above the caustic bead melt temperature. This effect was observed even though the exothermic heating of the caustic bead quickly raised the batch temperature from below the melting point of the caustic bead to well above the melting point.

Method of Using

The solid detergent composition can be degraded with water to form a liquid detergent composition. The liquid detergent composition can be provided as a use composition for application to a surface or substrate to be cleaned. Alternatively, a liquid concentrate can be provided that can be subsequently diluted to form the use composition. In general, it is expected that the solid detergent composition will be diluted with water. In general, it is expected that the water used for dilution will be softened water. In the case of using the solid detergent composition to clean vehicles in a commercial vehicle washing facility, softened water is expected to result in better cleaning than hard water. One reason for this is that hard water is expected to have a tendency to deplete the chelating and/or sequestering capacity of the detergent composition. In general, it is desired to use as much of the chelating and/or sequestering capability of the detergent composition for soil removal on a vehicle. Exemplary sources of water, however, include fresh water, recycled water, potable water, softened water, reverse osmosis water, deionized water, and non-potable water.

The liquid detergent composition can be formed by spraying water onto the solid detergent composition. The water dissolves a portion of the solid detergent composition and collects to form a concentrated liquid composition.

The concentrated composition can be diluted to an effective level such that satisfactory cleaning of the vehicle can be obtained. This dilution preferably includes a dilution of concentrate of at least about 1:1 and can be less than about 1:1000. The dilution can be about 1:10 to about 1:500, and about 1:100 to about 1:400. It will be apparent that the actual dilution ratio required may be varied by changing the amount of solvent (water, etc.) in the concentrate.

The composition, in addition to being used with the delivery systems described above, may also be used with other delivery systems that involve the solid composition itself or the dissolution of the solid composition and delivery of the solution formed by dissolution in applications that include a spray, foam, gel, powder or liquid.

EXAMPLE

A solid detergent composition was made by mixing liquid components with powdered components to provide a mixture, and then molding the mixture into a desired shape. The mixture was heated by internal heating to a temperature greater than 130° F. to provide a melt. The internal heating was a result of movement of water to the hydratable alkaline component. The composition was allowed to cool to room temperature. This composition does not include a viscosity control component, and the composition would not form a melt with acceptable viscosity for casting into a solid detergent composition. The liquid components and the powdered components are identified below.

| | Charge % |
|---|---|
| Liquid Components: | |
| N-hydroxyethylethylenediaminetriacetic acid 38% | 15.00 |
| Ethylenediaminetetraacetic acid, 38% | 8.00 |
| Dehypon LS-54 | 5.00 |
| Surfonic L 24-7 | 4.50 |

-continued

| | Charge % |
|---|---|
| Powdered Components: | |
| Sodium. Hydroxide, Beads | 40.00 |
| Sodium metasilicate anhydrous | 14.00 |
| Sodium tripolyphosphate | 5.00 |
| Linear alkyl sulfonate, sodium salt | 8.50 |

Additional solid detergent compositions that include viscosity control components are available under the name SOLID GOLD From Ecolab Inc. One version of the product uses EDTA (ethylene-diaminetetraacetic acid) as a viscosity control component, and another version uses ATMP (aminotris(methylene phosphonic acid) salt) as a viscosity control component.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A solid detergent composition precursor consisting of:

(a) at least about 40 wt. % hydratable alkali metal hydroxide;

(b) about 10 wt. % to about 30 wt. % of a mixture of anionic, cationic, and nonionic surfactants, (c) water in an amount sufficient to allow the detergent composition precursor to solidify;

(d) at least about 1 wt. % of an ethylene-diaminetetraacetic acid viscosity control component to lower the viscosity of the detergent composition precursor;

(e) a sequestrant selected from the group consisting of acrylic acid polymers and acryl amide polymers;

(f) sodium metasilicate;

(g) optionally a chelating agent;

(h) optionally a flocculent; and (i) optionally a corrosion inhibitor.

2. The solid detergent composition precursor of claim 1, wherein the hydratable hydroxide is present in a range of from about 40 wt. % to about 80 wt. %.

3. The solid detergent composition precursor of claim 1, wherein the mixture of anionic, cationic and nonionic surfactants is present in a range from about 10 wt. % to about 20 wt. %.

4. The solid detergent composition precursor of claim 1, wherein the anionic surfactant is at least one of sulfonates and sulfates.

5. The solid detergent composition precursor of claim 1, wherein the nonionic surfactant is at least one of polyether surfactant, alcohol alkoxylate surfactant, and alkylphenol alkoxylate surfactant.

6. The solid detergent composition precursor of claim 1, wherein the cationic surfactant is an alkoxylated ammonium cationic surfactant.

7. The solid detergent composition precursor of claim 1, wherein the viscosity control component is present in a range from about 1 wt. % to about 40 wt. %.

8. The solid detergent composition precursor of claim 1, wherein the viscosity control component is present in a range from about 2 wt. % to about 30 wt. %.

9. The solid detergent composition precursor of claim 1, wherein the water is present in a range from about 5 wt. % to about 25 wt. %.

10. The solid detergent composition precursor of claim 1, wherein the chelating agent is present in a range from about 5 wt. % to about 80 wt. %.

11. The solid detergent composition precursor of claim 1, wherein the flocculent is present in a range from about 0.001 wt. % to about 20 wt. %.

12. The solid detergent composition precursor of claim 1, wherein the corrosion inhibitor is present in a range from about 0.01 wt. % to about 40 wt. %.

13. A method for manufacturing a solid detergent composition precursor comprising:

(a) mixing the detergent composition precursor according to claim 1;

(b) heating the detergent composition precursor to a temperature of at least about 130° F. to provide a heated mixture; and (c) molding the detergent composition precursor to provide a molded detergent composition precursor.

14. A method according to claim 13, wherein the step of heating comprises heating the composition precursor to a temperature of at least about 140° F.

15. A method according to claim 13, further comprising:

(a) maintaining the detergent composition precursor at a temperature of at least about 130° F. for a time sufficient to allow the hydratable alkali metal hydroxide to hydrate with at least a portion of the water.

16. A method according to claim 13, further comprising:

(a) cooling the molded detergent composition precursor to room temperature.

17. A method according to claim 13, wherein the step of molding comprises casting the detergent composition precursor into a mold.

18. A method according to claim 17, wherein the mold comprises a container having a size of about 0.5 gallon to about 3 gallon.

19. A method for manufacturing a solid detergent composition precursor comprising:

(a) mixing the detergent composition precursor according to claim 1;

(b) providing the composition precursor in a desired shape; and (c) heating the composition precursor to a temperature of at least about 130° F., and allowing the composition precursor to solidify.

20. A method according to claim 19, wherein the step of providing the composition precursor in a desired shape comprises placing the composition precursor into a container or a mold that has a configuration that provides the composition precursor with the desired shape once the composition precursor is solidified.

21. A method according to claim 19, wherein the solid detergent composition precursor has a size of 0.5 gallons to about 3 gallon.

22. A method for forming a liquid detergent composition comprising directing a stream of water against the solid detergent composition precursor according to claim 1 to degrade the solid detergent composition precursor and provide a liquid detergent composition.

23. A method according to claim 22, wherein the solid detergent composition precursor has a size between about 0.5 gallon to about 3 gallon.

* * * * *